US007610784B2

(12) United States Patent
Rohde et al.

(10) Patent No.: US 7,610,784 B2
(45) Date of Patent: Nov. 3, 2009

(54) KEYWAY COVER FOR A LOCK

(75) Inventors: Christopher Rohde, West Allis, WI (US); John Blomstrom, Milwaukee, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 11/956,581

(22) Filed: Dec. 14, 2007

(65) Prior Publication Data

US 2008/0141745 A1 Jun. 19, 2008

Related U.S. Application Data

(60) Provisional application No. 60/875,111, filed on Dec. 15, 2006.

(51) Int. Cl.
*E05B 17/18* (2006.01)
*E05B 67/36* (2006.01)

(52) U.S. Cl. ..... 70/455; 70/34; 70/56

(58) Field of Classification Search ..... 70/32–34, 70/56, 455

See application file for complete search history.

(56) References Cited

U.S. PATENT DOCUMENTS 2,132,287 A * 10/1938 Curtis et al. ..... 70/455
3,996,774 A * 12/1976 Best ..... 70/32
4,869,082 A * 9/1989 Appelbaum ..... 70/56
4,881,391 A * 11/1989 Villa et al. ..... 70/455
5,669,255 A * 9/1997 Albano ..... 70/56
5,832,762 A * 11/1998 McDaid ..... 70/455
5,946,957 A * 9/1999 Yamamoto et al. ..... 70/455
6,272,890 B1 * 8/2001 Huston ..... 70/455
6,766,671 B2 7/2004 Haczynski et al.
6,854,303 B2 * 2/2005 Shiao et al. ..... 70/56
7,290,415 B2 * 11/2007 Rosenberg et al. ..... 70/56

OTHER PUBLICATIONS

Master Lock, Pro Series Rekeyable Padlocks, product literature, date: unknown, p. 5.
Master Lock, ProSeries 6270 Lock Service Procedure, date: unknown, p. 4.
International Search Report and Written Opinion from International Application No. PCT/US07/87547 mailed Sep. 24, 2008.

* cited by examiner

*Primary Examiner*—Peter M Cuomo
*Assistant Examiner*—Christopher Boswell
(74) *Attorney, Agent, or Firm*—Calfee, Halter & Griswold LLP

(57) ABSTRACT

A lock assembly includes a lock body and a keyway covering member. The lock body includes a keyway disposed on an outer surface. The keyway covering member is assembled with the outer surface of the lock body, and is slideable between a covering orientation and an uncovering orientation. When the keyway covering member is in the covering orientation, a covering portion of the keyway covering member aligns with the keyway to cover the keyway. When the keyway covering member is in the uncovering orientation, an opening in the keyway covering member aligns with the keyway to permit insertion of a key in the keyway.

14 Claims, 4 Drawing Sheets

KEYWAY COVER FOR A LOCK

CROSS-REFERENCE TO RELATED APPLICATION

This application claims the benefit of the U.S. Provisional Patent Application Ser. No. 60/875,111, entitled KEYWAY COVER FOR A LOCK and filed on Dec. 15, 2006, the entire disclosure of which is hereby incorporated by reference, to the extent that it is not conflicting with the present application.

BACKGROUND OF THE INVENTION

Due to the many outdoor uses of padlocks, protective covers have been provided to minimize the exposure of the padlock, particularly the keyway and the internal components of the padlock, to moisture and other contaminants, in an effort to extend service life by minimizing corrosion or oxidation of metallic lock components and damage caused by contamination. Previously proposed covers have been provided with a keyway cover to be fitted over a portion of the lock body on which the keyway is disposed.

To open the lock, the keyway covering portion of the previously proposed covers may be removed to access the keyway. However, this may present the risk of loss or accidental removal of the keyway cover. In other proposed embodiments, a keyway covering portion may be provided with an expandable opening to access the keyway without removing the keyway cover. The opening in some proposed covers has been limited to a slit in the flexible bottom portion, allowing the material at the slit to be pressed open when a key is pressed against the slit for insertion in the keyway, or allowing the slit to be opened by squeezing the ends of the cover, similar to the operation of a plastic coin purse. After the key is removed from the lock, the slit contracts back to its original form. However, this type of slit in the bottom cover may allow moisture or other contamination to enter the keyway through the slit, particularly if repeated unlocking of the lock has resulted in plastic deformation of the cover material, causing the slit to widen.

SUMMARY

The present application contemplates providing a keyway cover for a lock. In one embodiment, the keyway cover may be assembled with the lock and movable between covering and uncovering orientations, without removal (and risk of loss) of the cover.

Accordingly, in one embodiment, a lock assembly includes a lock body and a keyway covering member. The lock body includes a keyway disposed on an outer surface. The keyway covering member is assembled with the outer surface of the lock body, and is slideable between a covering orientation and an uncovering orientation. When the keyway covering member is in the covering orientation, a covering portion of the keyway covering member aligns with the keyway to cover the keyway. When the keyway covering member is in the uncovering orientation, an opening in the keyway covering member aligns with the keyway to permit insertion of a key in the keyway.

BRIEF DESCRIPTION OF THE DRAWINGS

Features and advantages of the invention will become apparent from the following detailed description made with reference to the accompanying drawings, wherein.

DETAILED DESCRIPTION OF THE INVENTION

This Detailed Description of the Invention merely describes embodiments of the invention and is not intended to limit the scope of the claims in any way. Indeed, the invention as claimed is broader than and unlimited by the embodiments described herein, and the terms used have their full ordinary meaning.

According to an inventive aspect of the present application, a padlock may be provided with a protective keyway cover, for example, to prevent the keyway from being exposed to moisture and other contaminants. In one embodiment, a keyway cover is assembled with the padlock such that the keyway cover is slideable between a covering position and an uncovering position. Many different types of locks may be configured to utilize a keyway cover. As one example, a keyway cover may be provided for a padlock having a lock body configured to define a recess for receiving aligned locking tabs, with a locking shackle pin extending from the lock body through the recess to engage the locking tabs. This type of lock is often referred to as a "hidden shackle" or "shackleless" padlock, as there is no exposed shackle when the padlock is locked, or as a "hockey puck" lock, as the padlock's lock body may (but need not) be shaped like a cylindrical disk or hockey puck. In one such exemplary lock, a keyway may be disposed on an outer periphery of the lock body.

While the specification and drawings of the present application specifically describe a shackleless lock including various inventive features, it should be apparent that these inventive features may be applied to other types of key-operated locks, such as, for example, padlocks, cable locks, U-bar locks, and door locks.

Figure 1:
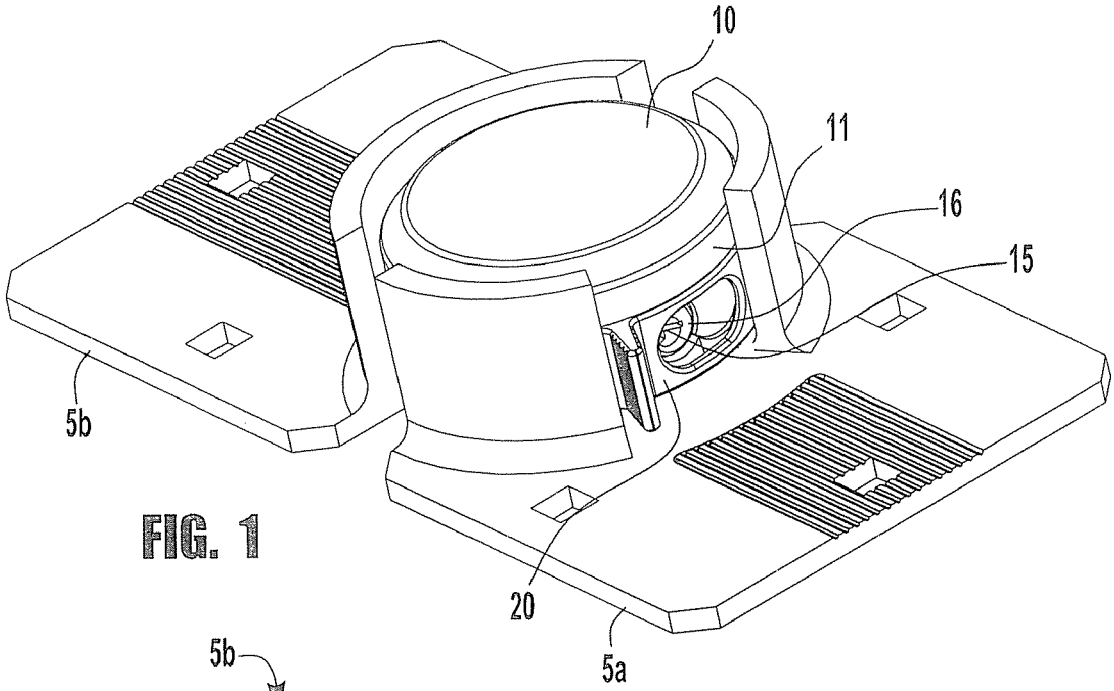
FIG. 1 illustrates a side perspective view of a shackleless padlock and locking tab assembly.
Figure 1A:
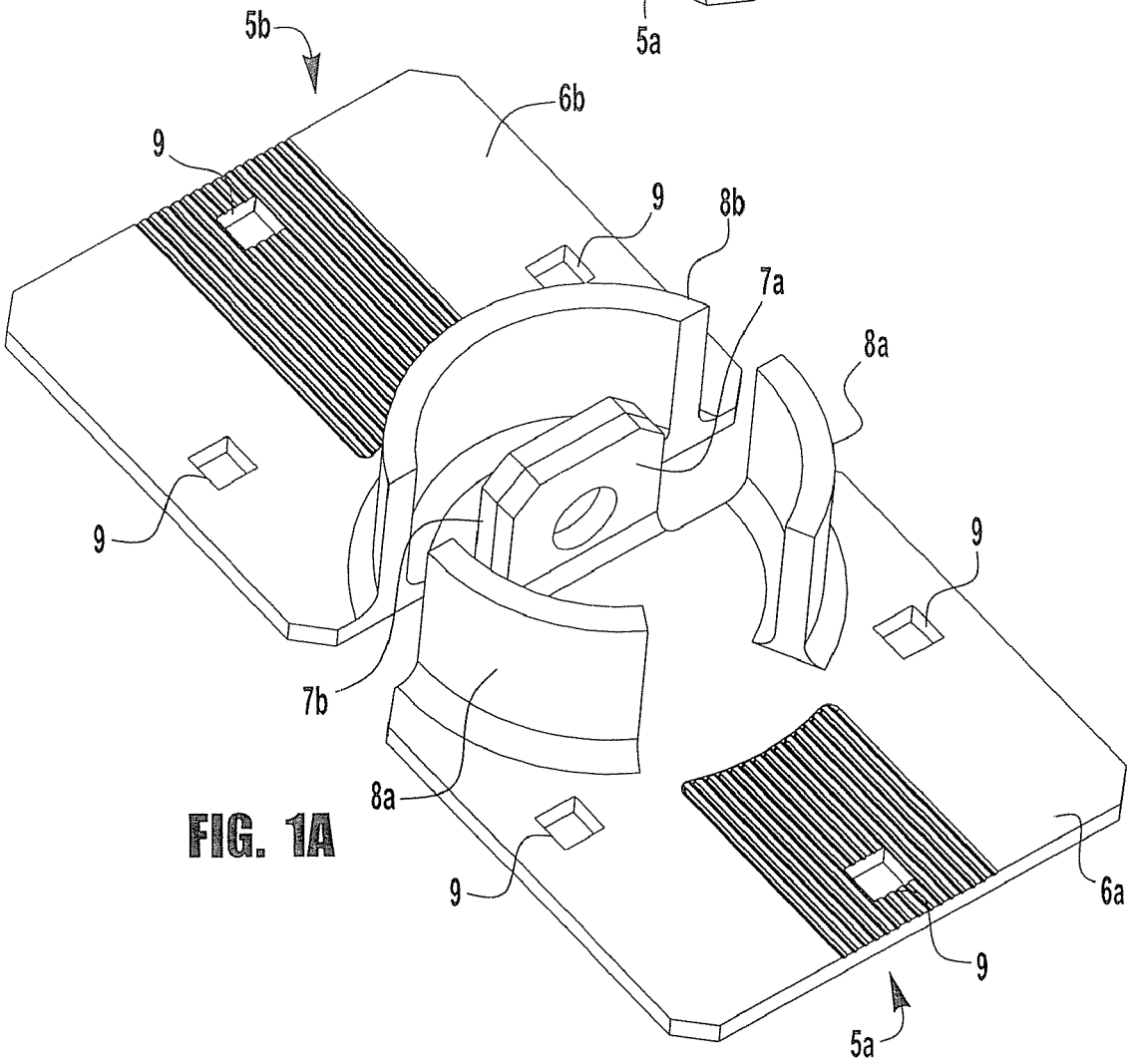
Figure 2:
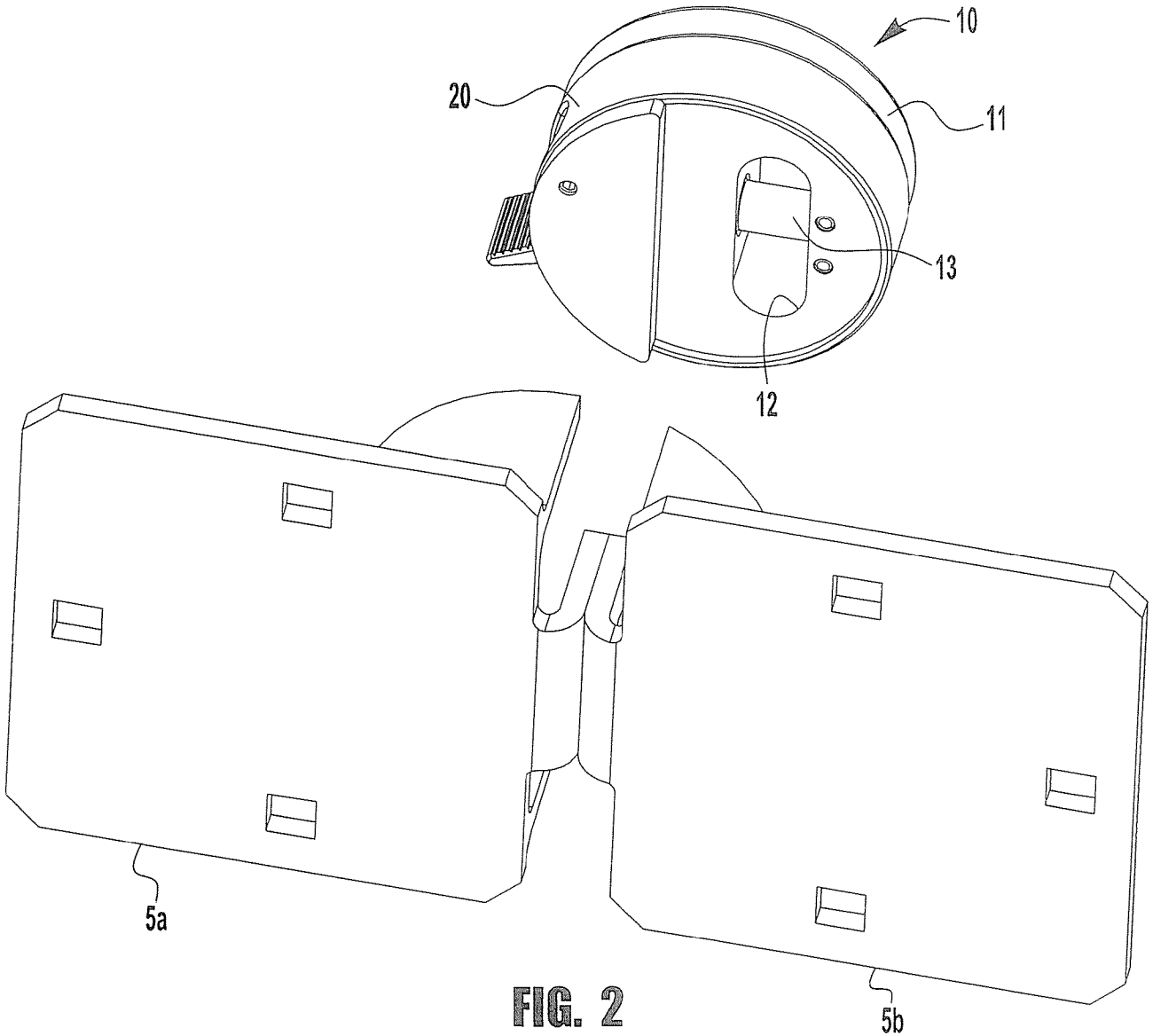
FIG. 2 illustrates a rear partially exploded perspective view of the shackleless padlock and locking tab assembly of FIG. 1.
Figure 3:
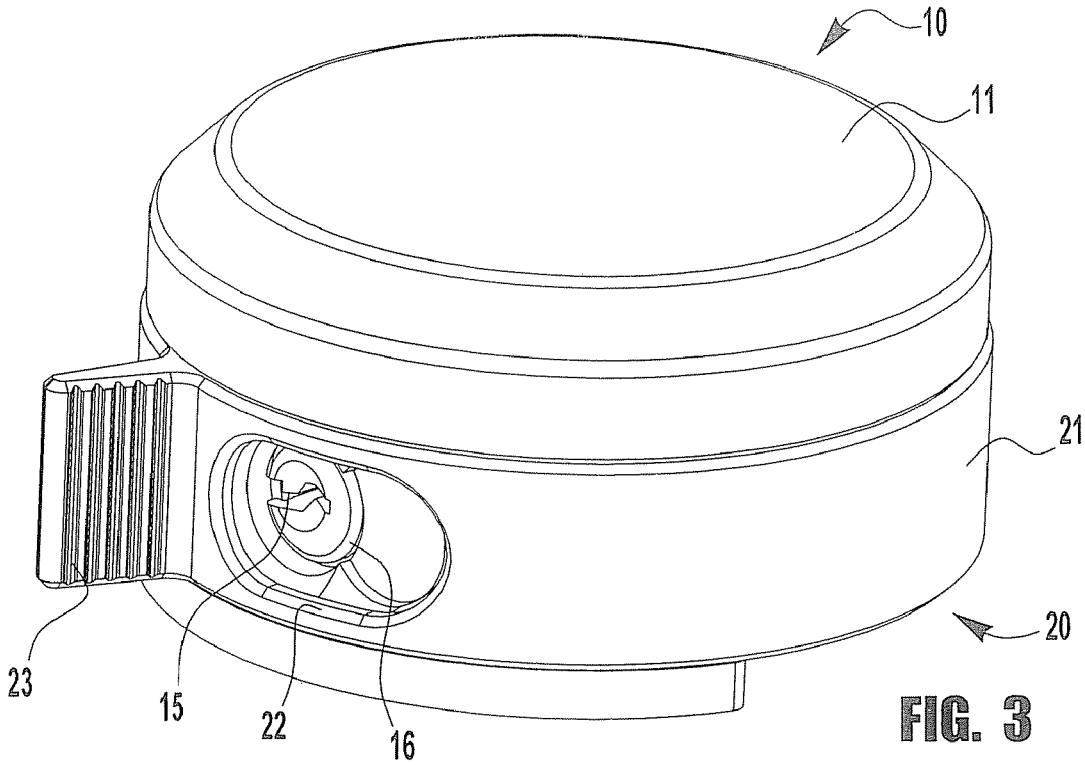
FIG. 3 illustrates a side perspective view of the shackleless padlock of FIG. 1.

FIGS. 1-6 illustrate various views and portions of an exemplary lock 10 with sliding keyway cover or keyway covering member 20. The lock 10 is a shackleless lock having a cylindrical lock body 11 defining a recess 12 on a rear side of the lock body 11, as shown in FIG. 2. The recess 12 is sized to receive staples or tabs 7*a*, 7*b* of aligned locking plates 5*a*, 5*b*. While many different types of locking tabs may be used, the illustrated assembly shows the lock 10 as used with locking plates 5*a*, 5*b* comprising mounting plates 6*a*, 6*b*, loops or staples 7*a*, 7*b*, and side walls 8*a*, 8*b*, as shown in FIG. 1A. The mounting plates 6*a*, 6*b* may include mounting holes 9 for attaching the locking plates 5*a*, 5*b* to a structure to be locked or otherwise secured, such as, for example, metal doors of a storage facility. The exemplary plates 5*a*, 5*b* are shaped such that the lock 10 is received between the side walls 8*a*, 8*b*, and the staples 7*a*, 7*b* are aligned and received in the lock recess 12, to provide a compact and secure locking arrangement.

The exemplary lock 10 includes a shackle pin 13 which is movable between an extended or locking position and a retracted or unlocking position. In the locking position, the shackle pin 13 passes through the staples 7*a*, 7*b* of plates 5*a*, 5*b* and across at least enough of the recess 12 to prevent removal of the lock 10 from the locking plates 5*a*, 5*b*. In the unlocking position, the shackle pin 13 is withdrawn from the plates, allowing the lock 10 to be removed from the plates 5*a*, 5*b*, and allowing the plates to be separated to access the locked area or equipment. A keyway 15 is disposed in a key cylinder 16 and is located on an outer periphery of the lock body 11.

Figure 4:
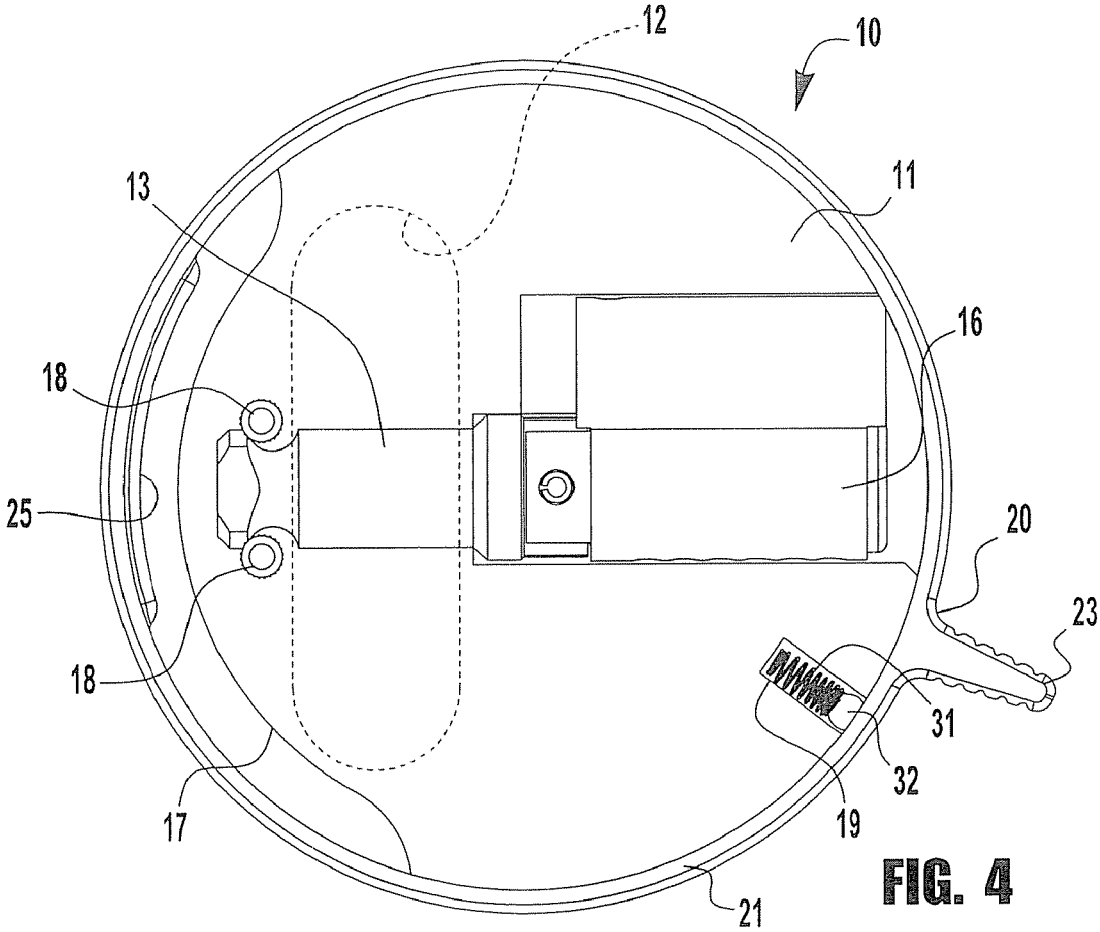
FIG. 4 illustrates an upper cross sectional view of the shackleless padlock of FIG. 1, with the lock body shown in phantom to illustrate additional features of the padlock.

In the illustrated embodiment, the shackle pin 13 is movable between locking and unlocking positions by a key operated mechanism, in which a key (not shown) is inserted into the keyway 15 and rotated to unlock the locking mechanism and retract the shackle pin 13. While many different locking mechanisms may be provided, in the illustrated embodiment, rotation of the keyway 15 using an authorized key (e.g., in a pin and tumbler locking arrangement, as known in the art) rotates the connected shackle pin 13 to disengage the shackle pin 13 from one or more locking members 18 in the lock body 11, as shown in FIG. 4. This allows the key cylinder 16 and shackle pin 13 to be moved for withdrawal of the shackle pin 13 from the staples 7*a*, 7*b*. One such locking mechanism is described in greater detail in U.S. Pat. No. 6,766,671, the entire disclosure of which is hereby incorporated by reference, to the extent that it is not conflicting with the present application.

Figure 5:
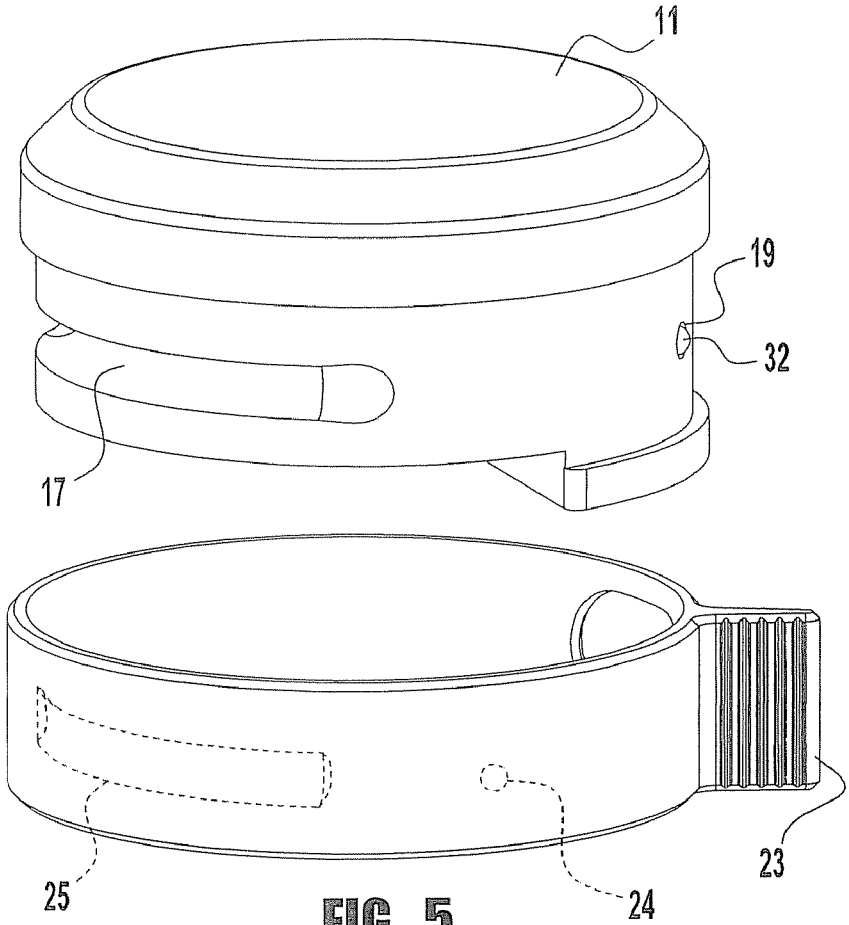
FIG. 5 illustrates a partially exploded side perspective view of the shackleless padlock of FIG. 1.
Figure 6:
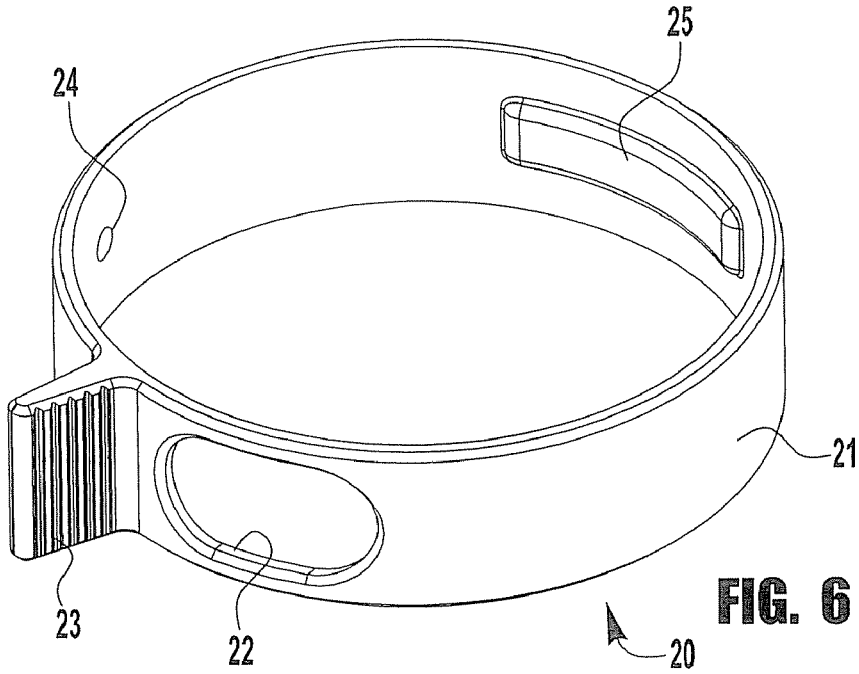
FIG. 6 illustrates a side perspective view of the keyway cover of the padlock of FIG. 1.

Many different types of cover members may be used to selectively cover the keyway of a padlock when the lock is not in use. In one embodiment, a cover member may be assembled with a lock body such that the cover member is slidable between a covering position and an uncovering position. In one such embodiment, the cover member may be assembled with the lock body such that the cover member is retained by the lock body in both covering and uncovering positions. The cover member may be secured to the lock body using many different sliding configurations, including, for example, projections (such as pins or tabs) which slide in corresponding grooves or a sliding cover member disposed between the lock body and an outer cover having an opening aligned with the keyway. When provided with a lock having a circular or cylindrical lock body, such as, for example, the illustrated lock 10 of FIGS. 1-5, the keyway covering member 20 may include a sleeve closely fitting with and surrounding the outer periphery of the lock body 11. In the illustrated example, the sleeve 20 includes an opening 22 that aligns with the keyway 15 when the keyway cover 20 is in an uncovering position or orientation. When the keyway cover 20 is moved to a covering position, the opening 22 is moved away from the keyway 15, and a covering portion 21 covers the keyway 15. To retain the sleeve 21 on the lock body 11, the lock body 11 may include a recessed band around the outer periphery, and the sleeve 21 may be provided in a flexible material capable of being stretched over the lock body 11 to be received in the recessed band. Additionally, the cover member 20 may include a projection 25 on the inner surface of the sleeve 21, as best shown in FIG. 6. The projection 25 may be received in, and ride along, a corresponding groove 17 in the outer periphery of the lock body 11, as shown in FIG. 5, thereby retaining the sleeve 21 on the lock body 11, while allowing the sleeve 21 to slide between covering and uncovering positions.

To facilitate movement of the sleeve 21 between covering and uncovering positions, the sleeve may be provided with a user graspable portion 23 that may be manipulated by the user to slide the sleeve 21. The user graspable portion 23 may be any suitable structure, including, for example, a knob, pin, or tab 23 (as illustrated). The user graspable portion 23 may be integrally molded with the sleeve 21 or assembled to the sleeve 21. The user graspable portion 23 may be textured or ribbed to facilitate grasping by a user.

To securely retain the sleeve 21 in the covering and/or uncovering positions, many different mechanisms may be provided. In one embodiment, a detent (which may, but need not, be spring loaded) may engage the keyway cover in covering and/or uncovering positions, for example, to provide sufficient resistance to prevent inadvertent movement of the keyway cover (for example, due to bumping or vibration), while permitting movement of the keyway cover through manipulation by the user. In the illustrated embodiment, a pocket 19 in the outer periphery of the lock body 11 retains a biasing member 31 (such as a compression spring) and a detent 32 (such as a ball bearing), as shown in FIG. 4. When the sleeve 21 is in at least one of the covering or uncovering positions (or in both positions) the detent 32 aligns with and is received into an indentation 24 (see FIG. 6) on an inner surface of the sleeve 21, thereby retaining the sleeve 21 in that position. The detent mechanism may be configured such that modest force applied by the user to slide the sleeve 21 is sufficient to press the detent 32 against the biasing member 31 to disengage the detent 32 from the indentation 24, allowing the sleeve 21 to slide. The engagement of the detent 32 with the indentations 24 may define the limits of travel for the cover member 20. However, in other embodiments, the travel path and stops for the cover member may be defined using other arrangements, including features of any one or more of the lock body, the cover member, and the tabs or locking plates with which the lock is to be used.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A lock assembly comprising:

a lock body having a keyway disposed on a cylindrical outer surface; and a keyway covering member assembled with the outer surface of the lock body, the keyway covering member including an inward extending projection received in a circumferential groove in the outer surface of the lock body to independently secure the keyway covering member to the body and permit slideable movement of the keyway covering member between a covering orientation and an uncovering orientation, wherein the circumferential groove extends around less than an entire circumference of the outer surface;

wherein when the keyway covering member is in the covering orientation, a covering portion of the keyway covering member aligns with the keyway to cover the keyway;

further wherein when the keyway covering member is in the uncovering orientation, an opening in the keyway covering member aligns with the keyway to permit insertion of a key in the keyway.

2. The lock assembly of claim 1, wherein the keyway covering member comprises a sleeve configured to fit around the outer surface.

3. The lock assembly of claim 1, wherein the keyway covering member further comprises a recess on an inner surface of the keyway covering member, and further wherein the lock body comprises a detent extending from the outer surface to engage the recess when the keyway covering member is in the covering orientation to secure the keyway covering member in the covering orientation.

4. The lock assembly of claim 3, wherein the detent is spring loaded.

5. The lock assembly of claim 3, wherein the keyway covering member further comprises a second recess on the inner surface of the keyway covering member, the second recess being positioned to engage the detent when the keyway covering member is in the uncovering orientation to secure the keyway covering member in the uncovering orientation.

6. The lock assembly of claim 1, wherein the keyway covering member further comprises a user graspable portion extending outward from an outer surface of the keyway covering member.

7. The lock assembly of claim 1, wherein the outer surface of the lock body further comprises a recessed band sized to closely receive the keyway covering member.

8. A lock assembly comprising:

a lock body having a keyway disposed on an outer surface; and a keyway covering member assembled with the outer surface of the lock body, the keyway covering member including an inward extending projection received in a circumferential groove in the outer surface of the lock body to independently secure the keyway covering member to the body and permit slideable movement of the keyway covering member between a covering orientation and an uncovering orientation, wherein the outer surface of the lock body further comprises a recessed band sized to closely receive the keyway covering member;

wherein when the keyway covering member is in the covering orientation, a covering portion of the keyway covering member aligns with the keyway to cover the keyway;

further wherein when the keyway covering member is in the uncovering orientation, an opening in the keyway covering member aligns with the keyway to permit insertion of a key in the keyway;

further wherein the keyway covering member is provided in a flexible material configured to be stretched over an outer portion of the lock body for receipt around the recessed band.

9. The lock assembly of claim 8, wherein the circumferential groove extends around less than an entire circumference of the outer surface.

10. The lock assembly of claim 8, wherein the outer surface of the lock body is cylindrical, and further wherein the keyway covering member comprises a sleeve configured to fit around the outer surface.

11. The lock assembly of claim 8, wherein the keyway covering member further comprises a recess on an inner surface of the keyway covering member, and further wherein the lock body comprises a detent extending from the outer surface to engage the recess when the keyway covering member is in the covering orientation to secure the keyway covering member in the covering orientation.

12. The lock assembly of claim 11, wherein the detent is spring loaded.

13. The lock assembly of claim 11, wherein the keyway covering member further comprises a second recess on the inner surface of the keyway covering member, the second recess being positioned to engage the detent when the keyway covering member is in the uncovering orientation to secure the keyway covering member in the uncovering orientation.

14. The lock assembly of claim 8, wherein the keyway covering member further comprises a user graspable portion extending outward from an outer surface of the keyway covering member.

* * * * *